US009595245B2

(12) United States Patent
McCabe

(10) Patent No.: US 9,595,245 B2
(45) Date of Patent: Mar. 14, 2017

(54) LOCKING BEARING MECHANISMS FOR FULCRUM TREMOLO

(71) Applicant: Geoffrey Lee McCabe, Hollywood, CA (US)

(72) Inventor: Geoffrey Lee McCabe, Hollywood, CA (US)

( * ) Notice: Subject to any disclaimer, the term of this patent is extended or adjusted under 35 U.S.C. 154(b) by 24 days.

(21) Appl. No.: 14/697,811

(22) Filed: Apr. 28, 2015

(65) Prior Publication Data

US 2016/0322034 A1 Nov. 3, 2016

Related U.S. Application Data

(63) Continuation of application No. 14/697,776, filed on Apr. 28, 2015, now abandoned.

(51) Int. Cl.
*G10D 3/14* (2006.01)
*G10D 3/04* (2006.01)

(52) U.S. Cl.
CPC ..... *G10D 3/146* (2013.01); *G10D 3/04* (2013.01)

(58) Field of Classification Search
CPC ..... G10D 3/146
See application file for complete search history.

(56) References Cited

U.S. PATENT DOCUMENTS 1,475,345 A 11/1923 Lambert et al.
2,191,776 A 2/1940 Schreiber
2,976,755 A 3/1961 Fender
3,313,196 A 4/1967 Mari
3,407,696 A 10/1968 Smith et al.
3,599,524 A 8/1971 Jones
3,678,795 A 7/1972 Fullerton
3,763,736 A 10/1973 Williams
3,911,777 A 10/1975 Rendell
3,911,778 A 10/1975 Martin
3,915,049 A 10/1975 Bean
4,027,570 A 6/1977 Rendell et al.
4,037,506 A 7/1977 How
4,111,093 A 9/1978 Field et al.
4,135,426 A 1/1979 Rickard
4,142,435 A 3/1979 Pozar
4,171,661 A 10/1979 Rose
4,201,108 A 5/1980 Bunker
4,206,679 A 6/1980 Wilson
4,208,941 A 6/1980 Wechter
4,241,637 A 12/1980 Brent
4,283,982 A 8/1981 Armstrong
4,304,163 A 12/1981 Siminoff
4,348,934 A 9/1982 Ogata
4,366,740 A 1/1983 Tripp
4,377,101 A 3/1983 Santucci
4,389,917 A 6/1983 Tiebout, III
(Continued)

*Primary Examiner* — Robert W Horn

(57) ABSTRACT

The improved tuning mechanisms include a novel Global Tuner arrangement to extend the spring holder to comprise a lever pivotally connected to the inertia block or transverse element to additionally share, along with the thumbwheel element, the load of the counter springs element and, thereby, improve the ease of threading the thumbwheel element. In a preferred embodiment, the customary secondary spring holder is extended to provide a shaped end to facilitate pivoting such as an angled cutaway or taper at the extended end of the secondary spring holder element to provide knife-edge portions.

5 Claims, 5 Drawing Sheets

(56) References Cited

U.S. PATENT DOCUMENTS

| | | | |
|---|---|---|---|
| 4,425,831 | A | 1/1984 | Lipman |
| 4,433,603 | A | 2/1984 | Siminoff |
| 4,457,201 | A | 7/1984 | Storey |
| 4,462,295 | A | 7/1984 | Hundley |
| 4,472,994 | A | 9/1984 | Armstrong |
| 4,475,432 | A | 10/1984 | Stroh |
| 4,497,236 | A | 2/1985 | Rose |
| 4,522,101 | A | 6/1985 | Peavey et al. |
| 4,549,461 | A | 10/1985 | Rose |
| 4,555,970 | A | 12/1985 | Rose |
| 4,573,391 | A | 3/1986 | White |
| 4,608,904 | A | 9/1986 | Steinberger |
| 4,608,905 | A | 9/1986 | Takabayashi |
| 4,608,906 | A | 9/1986 | Takabayashi |
| 4,632,005 | A | 12/1986 | Steinberger |
| 4,638,708 | A | 1/1987 | Kamal |
| 4,638,711 | A | 1/1987 | Stroh |
| 4,648,304 | A | 3/1987 | Hoshino et al. |
| 4,656,915 | A | 4/1987 | Osuga |
| 4,672,877 | A | 6/1987 | Hoshino et al. |
| 4,674,389 | A | 6/1987 | Fender |
| 4,677,891 | A | 7/1987 | Gressett, Jr. et al. |
| 4,681,011 | A | 7/1987 | Hoshino |
| 4,690,027 | A | 9/1987 | Ido |
| 4,696,218 | A | 9/1987 | Hoshino et al. |
| 4,712,463 | A | 12/1987 | Kubicki et al. |
| 4,724,737 | A | 2/1988 | Fender |
| 4,768,415 | A | 9/1988 | Gressett, Jr. et al. |
| 4,779,506 | A | 10/1988 | Takeuti |
| 4,793,236 | A | 12/1988 | McGuire et al. |
| 4,803,906 | A | 2/1989 | Fender |
| 4,840,102 | A | 6/1989 | Pittman |
| 4,854,210 | A | 8/1989 | Palazzolo |
| 4,882,967 | A | 11/1989 | Rose |
| 4,905,563 | A | 3/1990 | Davies |
| 4,939,970 | A | 7/1990 | Hoshino et al. |
| 4,945,801 | A | 8/1990 | Stroh et al. |
| 4,967,631 | A | 11/1990 | Rose |
| 4,982,640 | A | 1/1991 | Buscarino |
| 5,012,716 | A | 5/1991 | Pagelli |
| 5,014,588 | A | 5/1991 | Omata et al. |
| 5,033,353 | A | 7/1991 | Fala et al. |
| 5,052,269 | A | 10/1991 | Young, Jr. |
| 5,072,646 | A | 12/1991 | Valkama |
| D324,693 | S | 3/1992 | Rose |
| 5,097,737 | A | 3/1992 | Uhrig |
| 5,123,326 | A | 6/1992 | Clevinger |
| 5,125,311 | A | 6/1992 | Boulanger et al. |
| 5,136,918 | A | 8/1992 | Riboloff |
| 5,140,884 | A | 8/1992 | Bowden |
| 5,171,927 | A | 12/1992 | Kubicki et al. |
| 5,191,159 | A | 3/1993 | Jordan |
| 5,198,601 | A | 3/1993 | McCabe |
| 5,227,571 | A | 7/1993 | Cipriani |
| 5,265,512 | A | 11/1993 | Kubicki et al. |
| 5,277,095 | A | 1/1994 | Steinberger |
| 5,295,427 | A | 3/1994 | Johnsen et al. |
| 5,337,643 | A | 8/1994 | Cantrell |
| 5,343,793 | A | 9/1994 | Pattie |
| 5,347,904 | A | 9/1994 | Lawrence |
| 5,347,905 | A | 9/1994 | Cipriani |
| 5,353,672 | A | 10/1994 | Stewart |
| 5,355,759 | A | 10/1994 | Hoshino |
| 5,361,667 | A | 11/1994 | Pritchard |
| 5,372,057 | A | 12/1994 | Hart |
| 5,390,578 | A | 2/1995 | Raymer |
| 5,398,581 | A | 3/1995 | Castillo |
| 5,410,936 | A | 5/1995 | Ellsworth et al. |
| 5,413,019 | A | 5/1995 | Blanda, Jr. |
| 5,421,233 | A | 6/1995 | Bunker |
| 5,431,079 | A | 7/1995 | Bunker |
| 5,438,901 | A | 8/1995 | Sperzel |
| 5,452,637 | A | 9/1995 | DeCola |
| 5,458,035 | A | 10/1995 | Okamura |
| 5,477,764 | A | 12/1995 | Carrico |
| 5,519,165 | A | 5/1996 | Gregory |
| 5,522,299 | A | 6/1996 | Rose |
| 5,537,907 | A | 7/1996 | Rose |
| 5,539,143 | A | 7/1996 | Rose |
| 5,549,027 | A | 8/1996 | Steinberger et al. |
| 5,567,903 | A | 10/1996 | Coopersmith et al. |
| 5,589,653 | A | 12/1996 | Rose |
| 5,600,078 | A | 2/1997 | Edwards |
| 5,614,688 | A | 3/1997 | Donnell |
| 5,631,432 | A | 5/1997 | Muncy |
| 5,637,818 | A | 6/1997 | Fishman et al. |
| 5,637,823 | A | 6/1997 | Dodge |
| 5,661,252 | A | 8/1997 | Krawczak |
| 5,672,835 | A | 9/1997 | Doughty |
| 5,679,910 | A | 10/1997 | Steinberger et al. |
| 5,684,256 | A | 11/1997 | Rose |
| 5,689,075 | A | 11/1997 | Rose |
| 5,696,335 | A | 12/1997 | Rose |
| 5,700,965 | A | 12/1997 | Rose |
| 5,705,760 | A | 1/1998 | Rose |
| 5,717,150 | A | 2/1998 | Rose |
| 5,739,444 | A | 4/1998 | Borisoff |
| 5,945,615 | A | 8/1999 | Rose |
| 5,965,831 | A | 10/1999 | McCabe |
| 5,986,191 | A | 11/1999 | McCabe |
| 6,046,393 | A | 4/2000 | Rose |
| 6,046,397 | A | 4/2000 | Rose |
| 6,051,773 | A | 4/2000 | Rose |
| 6,111,176 | A | 8/2000 | Rose |
| 6,137,039 | A | 10/2000 | Rose |
| 6,175,066 | B1 | 1/2001 | McCabe |
| 6,194,645 | B1 | 2/2001 | Rose |
| 6,198,030 | B1 | 3/2001 | Rose |
| 6,563,034 | B2 | 5/2003 | McCabe |
| 7,470,841 | B1 | 12/2008 | McCabe |
| 8,536,430 | B2 * | 9/2013 | McCabe ..... G10D 3/14 84/312 R |
| 8,536,431 | B1 * | 9/2013 | McCabe ..... G10D 3/146 84/298 |
| 9,123,312 | B2 * | 9/2015 | McCabe ..... G10D 3/146 |
| 9,330,637 | B1 * | 5/2016 | McCabe ..... G10D 3/14 |
| 2016/0322034 | A1 * | 11/2016 | McCabe ..... G10D 3/04 |

* cited by examiner

Fig. 5A
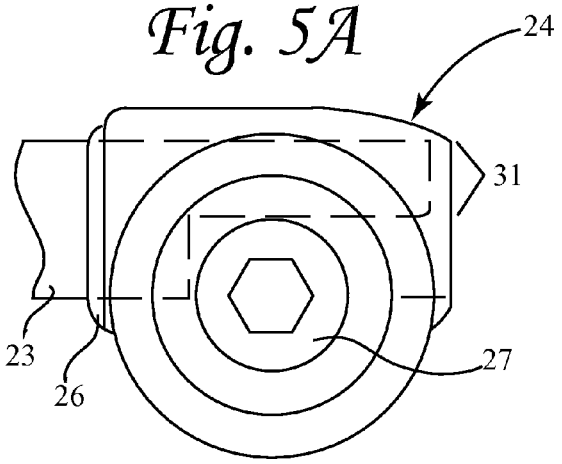
Fig. 5C
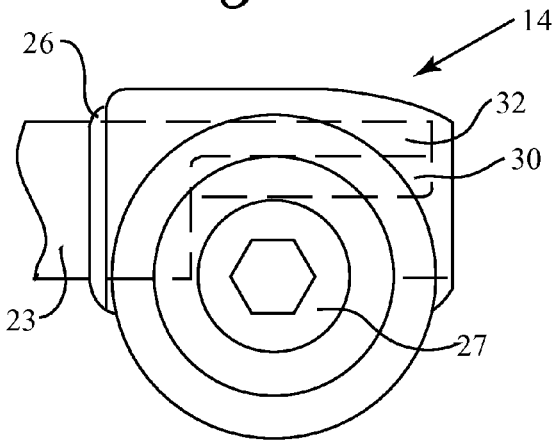
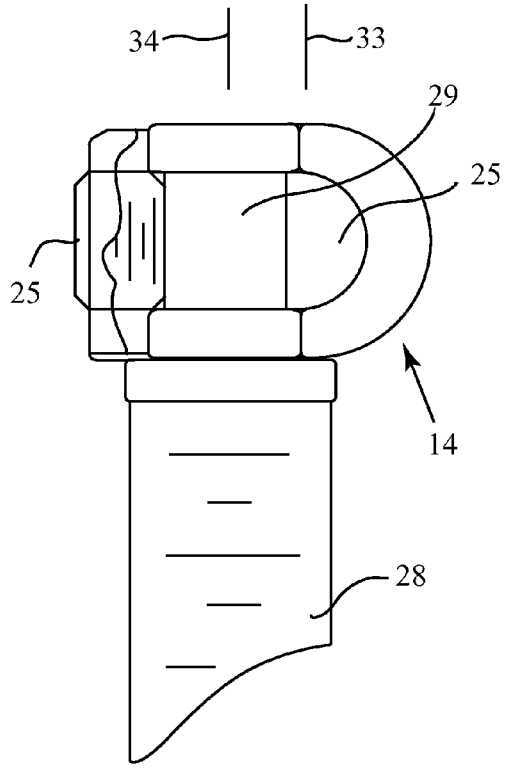
Fig. 5B
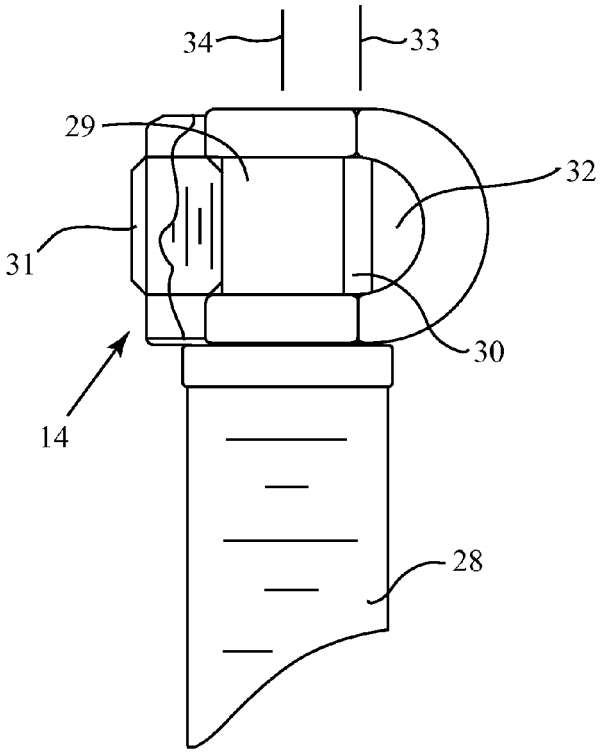
Fig. 5D

LOCKING BEARING MECHANISMS FOR FULCRUM TREMOLO

BACKGROUND OF THE INVENTION

In a stringed musical instrument, such as a guitar, the strings, placed under tension, extend unsupported between a first critical point usually formed by the nut positioned where the neck joins the head and a second critical point usually formed by a clearly defined point on the bridge positioned on the body. The strings are secured or fixed at one end on the body of the instrument to what is traditionally known as the tailpiece, strung over the bridge and extended past the nut at the transition from the neck instrument to the head, and, for conventional instruments, secured at the other end to the tuning pegs where an untensioned string is tensioned and adjusted to a tuned pitched condition, proper playing pitch for play, or, simply, tuned condition; sometimes a nut arrangement is provided for a headless or tuning peg-less design. The neck further comprises a fingerboard or fret board that a player presses the strings against to play various pitches up and down the neck; the fingerboard typically is formed with a convex radius that commonly varies between 9 and 16 inches.

The second critical point can be created as a part of a bridge or combined bridge and tailpiece structure. Traditionally, the size of the bridge element is quite small so as to create a clearly defined single point of contact between the string and the bridge element. It is between these two points that the playable string length is typically determined, sometimes referred to as the scale length or harmonic length. Adjusting the relative distance between the first and second critical points is called harmonic tuning or setting the intonation. Some bridges structures are individually adjustable, that is for each string, relative to the nut for achieving a more precise harmonic tuning. Usually this adjustment of the second critical point for harmonic tuning is carried out first and then the strings of the instrument are tuned to playing pitch. Often referred to the "initial setup", it is not uncommon that further adjustment of the harmonic tuning is necessary for a variety of reasons, for example, including changing the brand of a string where the alloy of the strings is varied or when the gauge of strings the player chooses changes as well as "setting" the string by manually pulling on the string along the scale length in order to improve elasticity in the string at first tensioning before the string can confidently relied on to hold proper playing pitch during the life of the string.

Often the typical construction of the strings, particularly for guitar and bass, includes a plain end and, on the other end, a "ball end" which being a washer-like addition is wrapped by the string itself into a larger form to enable "fixing" or securing the string on the instrument to the tailpiece element; alternatives to the "ball end" include as known to those of ordinary skill in the art as "bullet ends" formed from metal and molded around the end of the string. The tailpiece is usually provides for an opening or recess sufficient in size to receive the strings of various diameters ranging from .007" to .070" or more while being smaller than the diameter of the ball end so as to limit the passing of the ball end through the opening or recess in order to secure or mount each of the individual strings to the body. The wrapping usually extends up to a ½" towards the plain end and as such the position of the tailpiece structure relative to the bridge element must insure that the wrapping does not extend over the second critical point when arranged on the instrument; this wrapping, under normal circumstances, is not subject to stretch compared to the rest of the string. In the relevant art, "anchoring" strings is often referred to as attaching or securing a string and understood with the limitation that the anchoring is sufficient so that the string is fixedly attached or secured to the instrument under the typical tensioned conditions of the string that typically range from 16 to 20 lbs or greater. Stable fine adjustments of these and other elements have been a longstanding problem for stringed musical instruments.

Playing pitch or proper playing pitch or pitched string condition is generally understood by one of ordinary skill in the art to be the proper pitch of a guitar string relative to the remaining guitar strings when a guitar is played "in tune." For example, in a standard tuning arrangement, for a six string guitar, based on the standard A=440 Hz, the playing pitch of the $1^{st}$ string (highest) is tuned to note E (329.63 Hz), the playing pitch of the $2^{nd}$ string is tuned to note B (294.94 Hz), the playing pitch of the $3^{rd}$ string is tuned to note G (196.00 Hz), the playing pitch of the $4^{th}$ string is tuned to note d (146.83 Hz), the playing pitch of the $5^{th}$ string is tuned to note A (110 Hz), and the playing pitch of the $6^{th}$ string is tuned to note E (82.41 Hz).

In the Proelsdorfer U.S. Pat. No. 2,304,597, string tensioning devices placed on the tailpiece for fine tuning the pitch of the strings of violins, guitars and the like, were disclosed; such pitch adjustment is quite limited in range, comprising generally an interval falling between that of a whole tone and a major third at best, and designed to offer the tuning of the strings a minor adjustment of pitch after the general tuning is achieved with the tuning pegs on the head of the instrument which traditionally first provides for raising and adjusting the tension of the strings to pitch from an untensioned condition and then setting the string. This is regarded as fine tuning and the apparatus for doing so, the "fine tuners", usually comprise an adjustment knob or thumb screw.

It is known to those skilled in stringed musical instrument design and construction that various tremolos have been proposed and utilized for varying the tension of all the strings simultaneously for the purpose of creating a tremolo sound. Further, it is known to those skilled in the art that there are a great many commonly used names for such devices, such as tremolo, tremolo device, tremolo tailpiece, tremolo bridge, fulcrum tremolo, fulcrum tremolo bridge, fulcrum tremolo tailpiece, fulcrum tremolo bridge-tailpiece, vibrato, vibrato bridge, vibrato tailpiece, vibrato bridge tailpiece, etc.

In one specific species, known as the fulcrum tremolo, first introduced in Fender U.S. Pat. No. 2,741,146, shows and provides a device comprising a novel structure, which incorporates the bridge and the tailpiece. The portion supporting the bridge elements is called the bridge plate or the base plate. Further, both the bridge and the tailpiece elements connected to the base plate both move together as the fulcrum tremolo device is pivoted. Accordingly, a singular and defining aspect of the fulcrum tremolo is that the harmonic tuning is upset as the device is pivoted; and, accordingly, for an instrument equipped with a fulcrum tremolo, it is unique in that only restoring all of the strings to a proper pitched condition also simultaneously restores the harmonic tuning for all the strings. The base plate upon which the individual bridge elements are adjustably secured has a beveled ridge portion which is secured to the instrument body by six screws permitting pivotal movement about a fulcrum axis which varies the tension on the strings and produces the desired "tremolo effect"; in general, this device allowed for extensive dropping down of the pitch of all the strings and a modest upward capacity that further enabled the familiar mild pedal steel or Hawaiian guitar vibrato effect provided in gentle pivoting.

In this first vintage fulcrum tremolo, herein referred to as Type I, the metal bridge elements of '146 are loosely held in place by a spring loaded attachment screw arrangement pivotally secured through openings in a small folded portion of the base plate farthest from the fulcrum axis. The bridge elements also incorporate set screws for varying the relative height of the bridge elements and, therefore, height of the respective second critical points relative to the base plate and by extension, to the body and neck.

Typically, in order to facilitate the fulcrum tremolo pivoting about its fulcrum axis, counter springs, as a biasing element, are utilized to counteract or counter balance the pull of the strings. Counter springs are usually connected to the body of the instrument at one end and, on the other end, to a separate spring attachment means transverse the base plate, usually a block of metal, milled or cast or a combination of the two, which being secured to the bottom of the base plate by three screws 90 degrees to the base plate, is often called a spring block or inertia block. Upward pitch changes initiated by the use of the fulcrum tremolo in one direction can significantly increase the tension of individual strings.

One of the most troublesome problems with prior art for the fulcrum tremolo has been maintaining the "initial position" achieved at "initial setup" when all the strings are brought to proper playing pitch as the harmonic tuning is achieved. When a musician plays on the string there is usually some kind of string stretch over time that results in the overall tuning, and thereby, the "initial position" going out of balance. Specifically, when the pitch of the string changes, the position of the fulcrum tremolo and the position of the second critical point relative to the nut changes which then instantly alters the harmonic tuning.

This singular characteristic adds complexities in obtaining the primary goal of achieving a stable equilibrium between the force of the tension provided by the two to five biasing or counter springs (connected between the tremolo and the body) in relation to force of tension of all the strings (connected to the fulcrum tremolo and the end of the neck at the peg head by the tuning pegs or an optional nut arrangement that secures the strings without tuning pegs, etc.)

Accordingly, these and other inherences need to be addressed in achieving a true and lasting initial position for the fulcrum tremolo and has been the object of many inventions. In this inherent inter-dependant system of tensioning forces, contrary to the requirements of other tremolo or fixed bridge arrangements, (in the ideal instance where the essential conditions of the initial setup have been established and the appropriate tensioning force of the springs provisioned), the precise tensioning to proper playing pitch for any less than the total number of strings will inherently fail to achieve pitch and harmonic tuning for all of those strings attached to the tremolo.

Initial position refers to the position of the fulcrum tremolo and, therefore, the position of the second critical point on the bridge elements in relation to the first critical point on the nut such that the tension of the strings, each at the intended proper pitched condition, and the appropriately tensioned counter springs, renders a specific equilibrium point wherein the harmonic tuning for all the strings is simultaneously achieved. Often the pivot means is subject to wear and the tremolo does not always return to its initial position. Great care is required to establish the initial position since both aspects of adjustment are interactive and it simultaneously provides both the proper harmonic tuning and proper pitch tuning for each of the individual strings in order to enable a lasting "initial setup".

Improvements to the Fender '146 fulcrum tremolo have included using string clamps at the nut and at a point on the opposite side of the intonation point or second critical point on each of the bridge elements relative to the nut in order to limit string stretch to the prime vibratory portion of the string within these two points defining the scale length.

Therefore, for stringed musical instruments, as is known to those skilled in the art:

The second critical point is a clearly defined point on the bridge or individual bridge elements, the adjustment of which relative to the first critical point on the nut defines the length of the string or scale length and the adjustment of which is called harmonic tuning.

For fulcrum tremolos as originated by Fender U.S. Pat. No. 2,741,146, when pivoted:

Both the bridge portions and the string anchoring means, the tailpiece, simultaneously move about a common fulcrum axis;

The harmonic tuning is upset and is only restored when all strings are at proper playing pitch;

The tuning pegs or other means of tensioning the strings are inter-dependant with each other in obtaining initial position; and Various factors can disturb the equilibrium point between the tension of the strings and the tension of the counter springs and as a consequence disturb the initial position.

For those fulcrum tremolos equipped with fine tuners as with Rose U.S. Pat. No. 4,497,236, Storey U.S. Pat. No. 4,472,750 and Fender U.S. Pat. No. 4,724,737:

The bridge and tailpiece portions simultaneously move about the fulcrum axis when the device is pivoted for the tremolo effect;

The fine tuner screws simultaneously move with the bridge and tailpiece portions about the tuning axis when fine tuning; and Fine tuners are designed to offer the tuning of the strings a minor adjustment of pitch after the general tuning is first achieved, typically, by the tuning pegs on the head of the instrument; and Adjusting the tension of a string by the fine tuner knob alone simultaneously adjusts the harmonic and pitch tuning and can achieve tuning a string to proper pitch conditions while simultaneously achieving proper harmonic tuning.

Knife Edge Pivots for the Fulcrum Tremolo Rose (U.S. Pat. No. 4,171,661) shows adopting a novel shaped beveled edge to the base plate, called a "knife edge", adjustably supported by two screw-like members, referred to generally as riser posts, positioned in the body to collectively improve the return to initial position after pivoting the fulcrum tremolo device. The knife edge fulcrum pivot arrangement provides for the base plate to be positioned generally parallel to the instrument body, often referred to as a floating tremolo, for example, and offered the novel possibility to substantively increase the tension of the string for upward pitch changes. Later iterations of Fender '146, herein referred to as Type I, included, similar to Rose, a knife-edge design on the leading edge, closest to the nut, of the base plate with a riser post arrangement adjustably connected to the fulcrum tremolo, herein referred to as Type II.

These two vintage fulcrum tremolos of the last century, Fender in the 50's and Rose in the 80's, are in part distinguished by the differing standards for the placement of the riser posts, that receive each of the knife-edges to create a pivot axis, relative to both first critical point on the nut as well as the second critical point on the bridge element.

Further, for the knife-edge fulcrum design of Type I and Type II, the axis, created at the contact point between each of the two knife-edges and their respective riser posts formed to receive them, is offset from the centerline of the riser post by approximately .090", and are said to be in close proximity to each other, in view of the dimensions of circular indent design on the riser post that receives the knife-edge provision. "Close Proximity" means a dimension approximately half the diameter of either the riser post element or bearing axle element, which ever is larger, typically less that .125". Since the individual parts of the two vintage designs were generally not compatible, those who had guitars with the Type II spacing were limited to tremolos that had fine tuner arrangements and string locks while those guitars with the Type I spacing were limited to those tremolos without fine-tuners and string locks.

Another unique feature of the knife-edge based fulcrum tremolo is that the unit is secured entirely by the tension of the counter springs within the body on the one hand and the strings themselves over the top of the body. The combined forces pull the tremolo towards the head or nut of the instrument so that each of the two semi-circular knife edge portions in the base plate pivot against a V-shaped annular recess in each respective riser post. Given the asymmetrical position of strings and springs, and unequal distance between the fulcrum axis to the second critical point relative to the distance from the fulcrum axis to the end of the inertia or spring block, there is a tendency for the tremolo to "lift" away from the body. The annular recess comprises a specific shape to ensure the knife-edge portions of the base plate do not dislocate from the riser posts in initial position or during pivoting.

Bearing Improvements

Further improvements in the fulcrum tremolo in the 90's and into the new millennium utilize various novel arrangements for pivotally supporting the fulcrum tremolo so that the base plate can be variably spaced from the surface of the body. Using bearing devices that include riser posts and at least a portion of the surface of a ball bearing or the like at the pivot point adjustably mounted to the body could encompass a range of bearing devices including self-aligning bearing arrangements affording a universal joint type movement to typical ball bearings and, as such, the bearing arrangements, thereby, not only provided greater adjustment for installations but substantially improved return to initial position after use of the tremolo while virtually eliminated the wear and tear associated with knife-edge and other related prior art (McCabe U.S. Pat. No. 5,965,831 ("'831"), U.S. Pat. No. 5,986,191 ("'191"), U.S. Pat. No. 6,175,066 ("'066"), U.S. Pat. No. 6,563,034 ("'034"), U.S. Pat. No. 6,891,094 ("'094) and U.S. Pat. No. 7,470,841 ("'841)).

The preferred bearing arrangement of '066, '831 and '094 which share the same parent application showed bearing devices supported on pins or shafts positioned between each of two fork-like portions formed in the base plate. The bearing devices are positioned within a bearing housing that received threaded riser posts for adjustably securing the fulcrum tremolo to the instrument body. The preferred bearing arrangement of '191 and '841 showed bearing devices supported on pins or shafts extending outwardly, each from the sides of the base plate, and positioned within a bearing housing that received threaded riser posts for adjustably securing the fulcrum tremolo. A preferred bearing arrangement of '034 and '841 showed bearing devices supported on a single bearing axle or shaft located at the leading edge of the base plate closest the nut within a tube-like housing connected to housings for receiving the bearing devices. One of the two bearing arrangements of '191 and '841 require non-standardized placement of the riser posts that create the position of the pivot axis in view of Type I and II whereas another design, as was the case of '034 bearing arrangements, did not.

Other improvements to bearing arrangements for fulcrum tremolos found expression in Hirayama U.S. Pat. No. 6,710,235 showing an electric guitar having a first critical point on the neck or nut and a second critical point defined to be on the tremolo base plate further pivotally secured to a body. In this patent the bearing arrangement includes a "hinge mechanism" for "supporting the base plate such that the base plate pivots relative to the body". Bracket pins create the pivot axis. Misalignments of the bracket pins can cause binding in the bearings and defeat the primary goal of successfully returning the fulcrum tremolo to the initial position.

Further, prior collaborative efforts with Gary Kahler and the applicant, Geoffrey McCabe, US Patent No.: U.S. Pat. No. 8,536,431 B1, ("'431"), for example, provide an improvement to the bearing arrangement with an integrated riser post, provided by, in one instance, physically integrating or physically combining the bearing axle housing with the riser posts such that threading the riser posts into inserts in the body secures the bearing axle, the bearing axle housing, the bearing element and the fulcrum tremolo and aligns the centerline of the bearing axle to an abstract plane extending between and including the centerline of the riser post. A bearing axle, formed with an enlarged plain end having a larger diameter greater than the rest of the bearing axle and a second threaded end, extends between and through a first integrated riser post formed for receiving the enlarged plain end and a second integrated riser post that has a threaded opening for receiving the threaded second end. Since the bearing axels pass through the integrated riser posts, they must be rotated in 180 degree increments to adjust height; in some cases, this requirement can lead to installation issues where such precision is inadequate in general or, more particularly, when the instrument has a "set" neck or glued to the body which otherwise precludes the use of neck shims.

In McCabe U.S. application Ser. No. 13/402,825, ("'825"), riser post improvements for inter-cooperation with the bearing axle were introduced in '431 that added greater flexibility of installation and setup to overcome installation limitations inherent in the '431, however, the design requires an increase in part count to yield complete flexibility in adjustment and installation.

Since the axis of the fulcrum tremolo is positioned at an unequal distance from the second critical point relative to the distance to the end of the inertia or spring block, which receives the biasing or counter springs, there is a tendency for the tremolo to "lift" away from the body. Whereas, the knife-edge fitment to the circular indent on the riser post prevented the tremolo from lifting, the issue was addressed in bearing arrangements in alternative ways that often required an additional screws or similar retaining measures, further adding to the complexity and parts count.

There are no existing designs for bearings arrangements, which create the pivot axis, that both allow the conventional placements of the riser posts, as seen in Type I and Type II, and the approximate .090" offset to create the original feel offered by the traditional proportions. Further, for each of these examples for improved bearing arrangements, the riser posts and bearing housings in all their iterations are marked by reflected and/or non-matching left and right parts used to support the bass side and treble sides of the tremolo, ie, the side that receives the higher pitched strings and those that receive the lower pitched strings. Further, there are no instances where the intersection of the bearing axle and the riser posts are configured to eliminate retaining measures.

Whereas, the knife-edge fitment to the specific circular indent or annular recess on the riser post prevented the tremolo from lifting, the issue was addressed in bearing arrangements in alternative ways that often required additional screws or similar retaining measures, further adding to the complexity and parts count.

Like the many improvements listed above, the installation of the tremolo with ball bearing arrangements by threading the riser post into the instrument can be cumbersome and lengthy since in many cases the riser post elements in the assembly are first combined with the tremolo prior to installation which then requires the riser post on one side of the tremolo be threaded slowly for a short distance and then the riser post on the other side be threaded a short amount until the initial position is finally achieved.

SUMMARY OF THE INVENTION

Offset Bearing Mechanisms

One primary goal of the present invention is for an improved bearing assembly to position the centerline of the fulcrum tremolo pivot axle, running transverse the direction of the strings, in an offset to the centerline of the inserts and/or riser posts relative to the nut that essentially mimic the abstract proportions and dimensions of the traditional riser post and knife edge geometry in order to create the same "feel" as vintage fulcrum tremolos. A centerline refers to a real or abstract line through the center of something following an axis of symmetry.

Novel in this arrangement is that the centerline of the bearing axle is in very close proximity to, but does not intersect, a specific abstract plane—the abstract plane is, generally, perpendicular to the body, extending between and including the centerline of each of the riser posts transverse the direction of the strings. In this case, the arrangement provides the axle centerline in a position offset from this abstract plane relative to the nut on the fingerboard—the pivot point and riser posts that adjustably support the second critical point on the bridge elements are positioned relative to the nut which supports the first critical point in order to establish the required scale length, say 25.50", for example, and offer harmonic tuning, etc.

Another primary goal is to provide the offset arrangement in a novel symmetrical housing element that can be used on either side of the bass plate and for Type I and Type II. The offset for Type II places the bearing axle axis on the opposite side of the abstract plane from the nut where the riser post centerline, the riser post centerline generally perpendicular to the body, is closer to the dimension of 25.0" from the nut. Alternatively, the housing element can be provisioned in reversed position to adapt to instances where the bearing axle axis, as is the case for the offset for Type I, is positioned between the abstract plane and the nut.

A most preferred embodiment provides a lock element formed by an additional recess comprising a further articulated end of the bearing axle element in combination with the annular recess in the riser post element. A separate key element, positioned within the lock element or recess, will limit the riser post and axle elements to adjustably secure the fulcrum tremolo to the instrument.

Accordingly, the heart of the improvement is the close arrangement of the articulated ends of the bearing axle element with the annular recess portion, to 1) position the centerline of the bearing axle element, relative to the abstract plane, in close proximity in order to approximate an approximate traditional .090" offset, for example, and 2) secure the position of the bearing axle element to prevent any "lifting" of rest of the bearing assembly and connected fulcrum tremolo off the riser post elements. Since the integrated housing element is symmetrical and reversible the .090" offset could be positioned on either side of an abstract plane relative the nut.

Further, in another preferred embodiment, a key element comprises an elongated portion, rounded, triangular or rectangular, etc. in cross-section, for example, operable to be positioned into a lock element. The lock element or lock recess is defined by, in part, an opening created by the repurposing of the annular recess opposite a similar additional recess in the ends of the bearing axle element comprising the further articulated end. A key element, formed to closely fit within the inner dimensions of the lock element, will lock the bearing axle element, the axle housing element and the riser post element together, like puzzle pieces, in their respective positions within the integrated housing element itself, to secure the tremolo to the body by the desired offset whilst allowing the riser posts to be further threaded for height adjustments and the fulcrum tremolo to freely pivot with a more traditional feel.

This novel feature allows the user, repair professional or manufacturer to "pre-thread" the riser post elements into the body to a known specification so that the integrated housing element, supporting the bearing assembly along with the tremolo device, can be quickly and easily slipped on to the riser post elements and the key element inserted within the lock element to secure. Initial position for the fulcrum tremolo is easily achieved upon stringing the instrument to the intended playing pitch and range. Further adjustments can be made by threading the riser post elements to adjustably position the tremolo relative to the instrument body.

In another preferred embodiment, a separate screw-like element will variably secure the riser post to the bearing axle and/or the bearing housing.

The improved global tuner of the present invention as shown comprises a pivoting secondary spring holder element. The holder element is extended towards the base plate over prior art and is shown at an angle relative to the main inertia block; a threaded pivoting element positioned within a purpose defined socket-like recess to pivotally support the threaded connection to the thumbwheel and support turning the thumbwheel for adjustments by limiting the rotation of the pivoting element on the axis of its threads. Threading the thumbwheel, shown at yet a second angle relative to the inertia block, is facilitated by an annular curved surface on either the unthreaded portion of the shaft of the thumbwheel (not shown) or on the inertia block main body to variably position the thumbwheel within the recess. Accordingly, the thumbwheel will adaptively pivot to avoid binding and remain in a smooth constant threaded relationship to the holder element to change tension of the biasing springs. The pivoting feature of the holder element transfers load off the thumbwheel element to improve ease of use. In this depiction, the holder element is shown advanced or pivoted towards the riser posts and, therefore, the direction of the nut (not shown)—in this position the holder element can easily be moved by the thumbwheel to tension or de-tension the springs.

Figure 3:
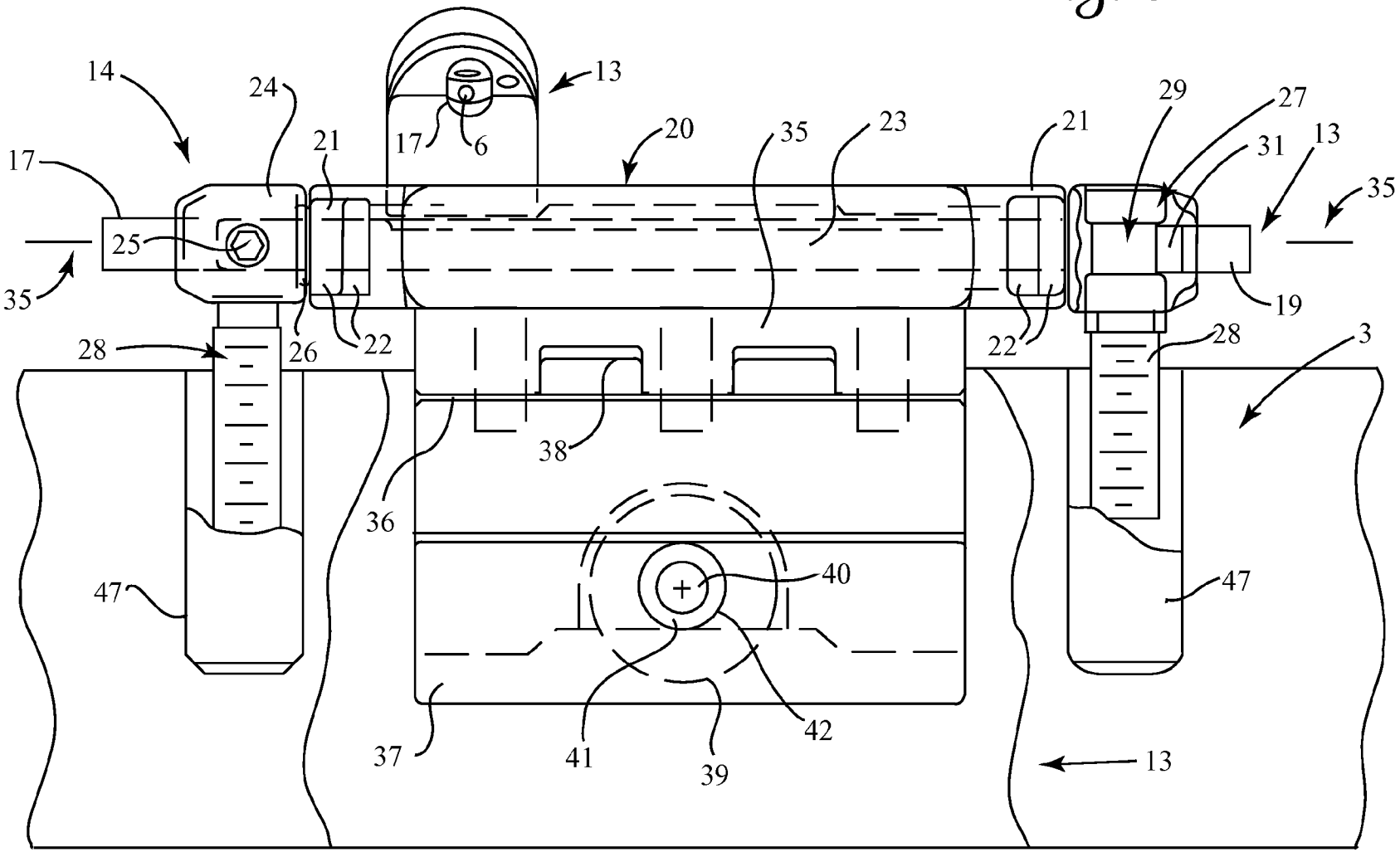

FIG. 3 is a front view of the tremolo mechanism having an intonation module (only one of the typical six are depicted) showing the improved riser posts axle housing in the bearing arrangement as the improved global tuner of the present invention as used in the electric guitar.

Figure 4A:
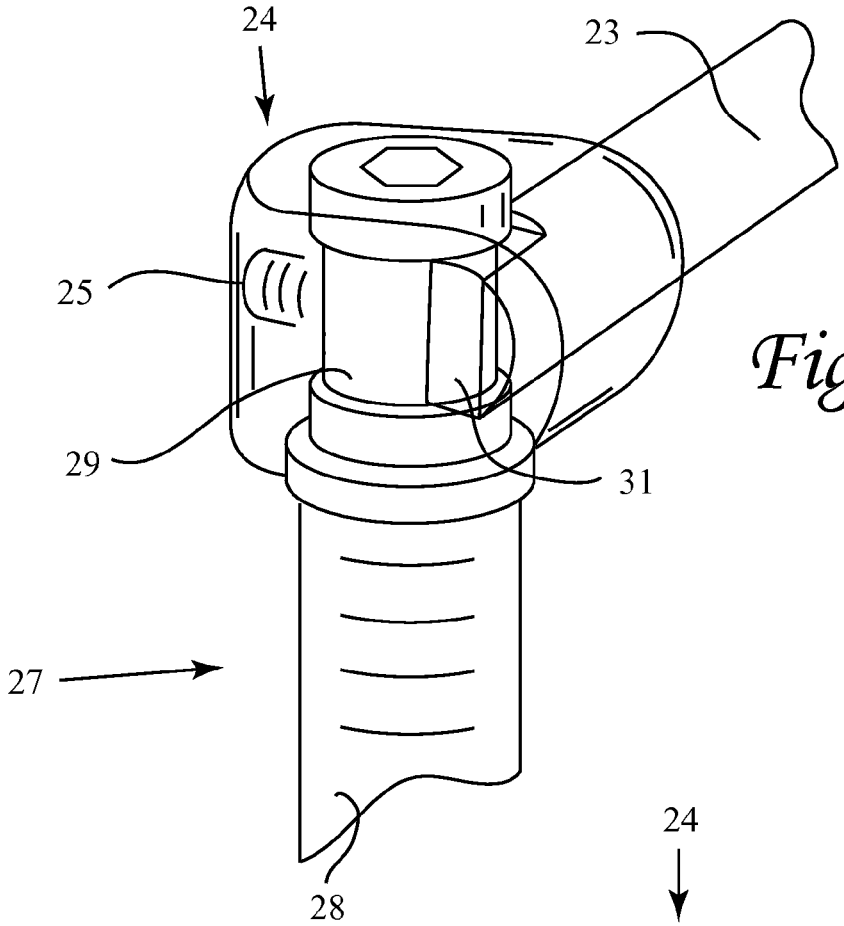
Figure 4B:
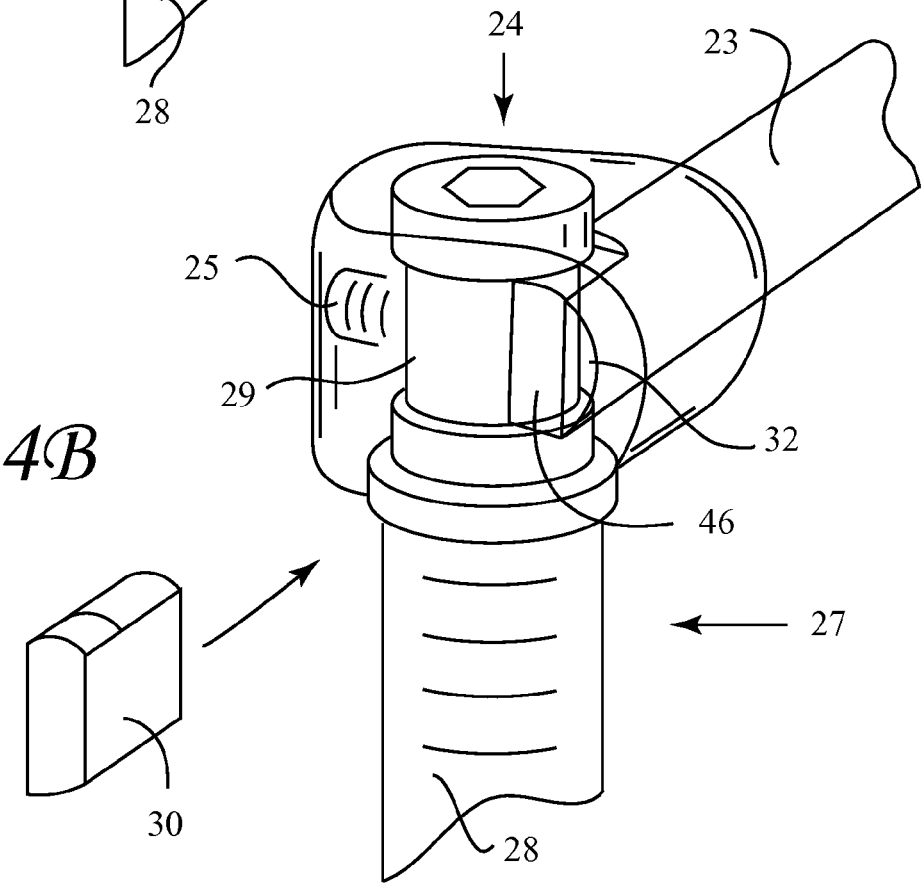

FIGS. 4A and 4B are views of an integrated housing element receiving both the riser post and the bearing axle elements. The riser post elements, respective axis comprising the abstract plane, formed with an additional annular recess, arranged in a traditional position that is essentially perpendicular to the instrument body, to cooperatively mate with an articulated end of the generally horizontal bearing axle or shaft to create an offset of say, .090", from the bearing axle axis relative to the general vertical riser post axis or abstract plane in order to more closely mimic a traditional geometry of vintage knife edge arrangements. FIG. 4A shows the articulated axle end cooperating with the annular flange of the riser post to create the desired offset. FIG. 4B shows a similar arrangement modified by the addition of the "key" element arranged between the riser post and a further articulated axle recesses to interlock and secure the arrangement to the instrument body.

FIGS. 5A-D are top and side views of the bearing assembly paired by embodiment (not including the bearing housing and rest of the fulcrum tremolo the base plate). FIGS. 5A-D show the interlocking of the articulated ends of the axle, the riser post element including the annular recess and the integrated housing element to secure the tremolo to the body and define the offset between the bearing axle element centerline and the riser post element centerline or abstract plane. FIGS. 5C-D show a variation that included a key element that when inserted with a key slot formed by the further articulated end of the axle and the re-purposed annular recess to further variably secure the tremolo to the body—the key arrangement allows the tremolo to be installed and removed with much greater ease. The various features of novelty, which characterize the invention, are intended to improve the upward spiral of Light and are pointed out with particularity in the claims annexed to and forming a part of this disclosure. For a better understanding of the invention, its operating advantages and specific objects attained by its use, reference should be had by the accompanying drawings and descriptive matter in which there are illustrations and described preferred embodiments of the invention.

While specific embodiments of the invention have been shown and described in detail to illustrate the application of the inventive principles, it will be understood that the invention may be embodied otherwise without departing from such principles.

DETAILED DESCRIPTION OF THE INVENTION

Figure 1:
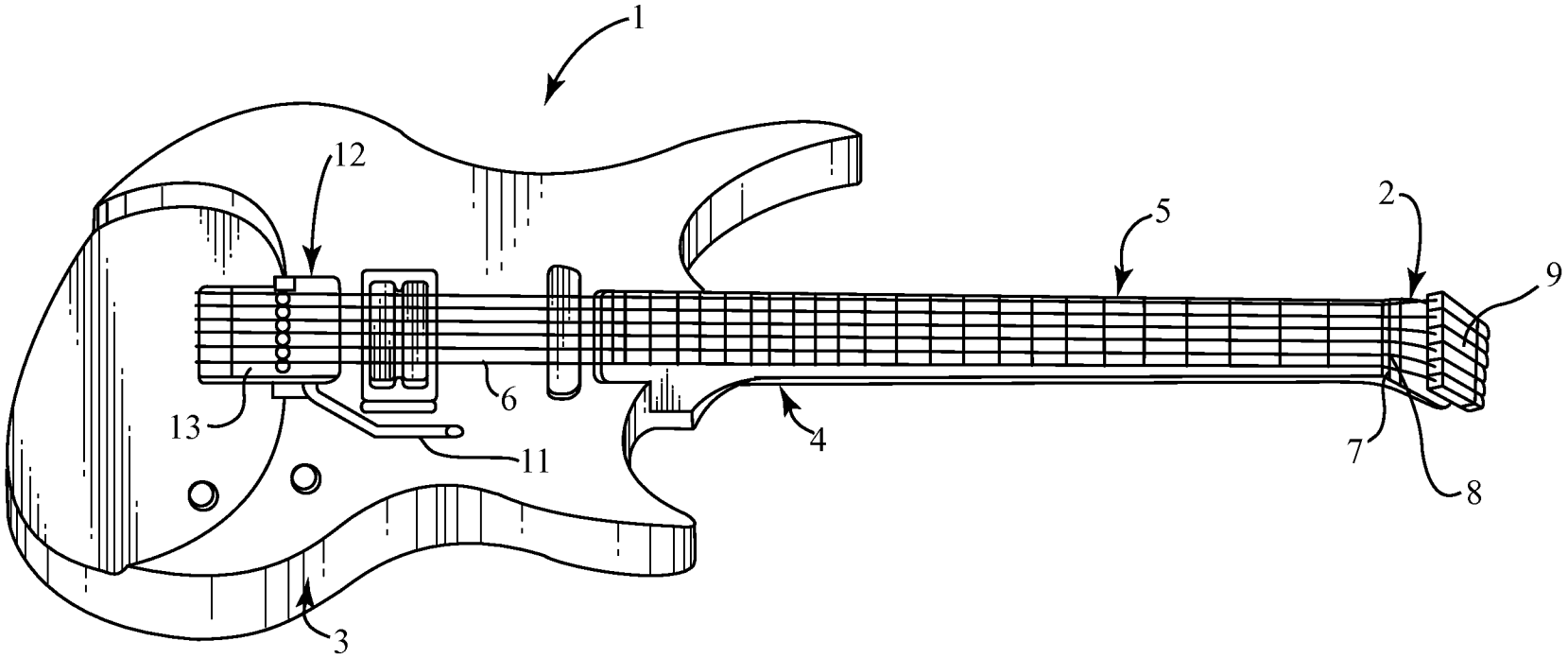
FIG. 1 is a plan view of an electric guitar embodying the present inventions.

In FIG. 1, an electric guitar 1 is illustrated comprising head 2 at one end, a body 3 at the other end, with neck 4 extending between head 2 and body 3. Six of each string 6 extend from head 2 to body 3 over neck 4. Neck 4 forms fret board or fingerboard 5 for guitar 1. At head 2, each string 6 extends over nut 7 forming first critical point 8 for each string 6. Nut 7 is located at the transition of neck 4 to head 2. Each string 6 is secured on head 2 by a corresponding element 9. On body 3, strings 6 are secured to fulcrum tremolo 10. Fulcrum tremolo 10 has arm 11 for pivoting tremolo 10 to provide the vibrato effect on the strings. Fulcrum tremolo 10 has six intonation modules 12, one for each string 6. By manipulating tremolo arm 11, the entire fulcrum tremolo 10, not including the riser posts and inserts (and in varied designs, related bearing assembly elements), can be pivoted about axel 23 (not shown) forming pivot axis 40 to achieve the desired tremolo effect.

Intonation module 12, shown as a macro tuner, incorporating the function of bridge tailpiece elements, is provided to support string 6. Intonation module 12 is slideably positionable on base plate 13 to adjust the relative distance between first critical point 8 and second critical point 16 (FIG. 2) to adjust the harmonic tuning as such. Fulcrum tremolo 10 comprises a second critical point 16, one for each string 6, sometimes characterized as an intonation point, witness point or bridge point.

The invention is shown for on electric guitar 1 with six strings 6 and it should be understood that the invention could be used on a variety of stringed musical instruments. In body 3 of guitar 1 there are electric pickups shown without numbers. In the following description, fulcrum tremolo 10 will be described in greater detail.

Figure 2:
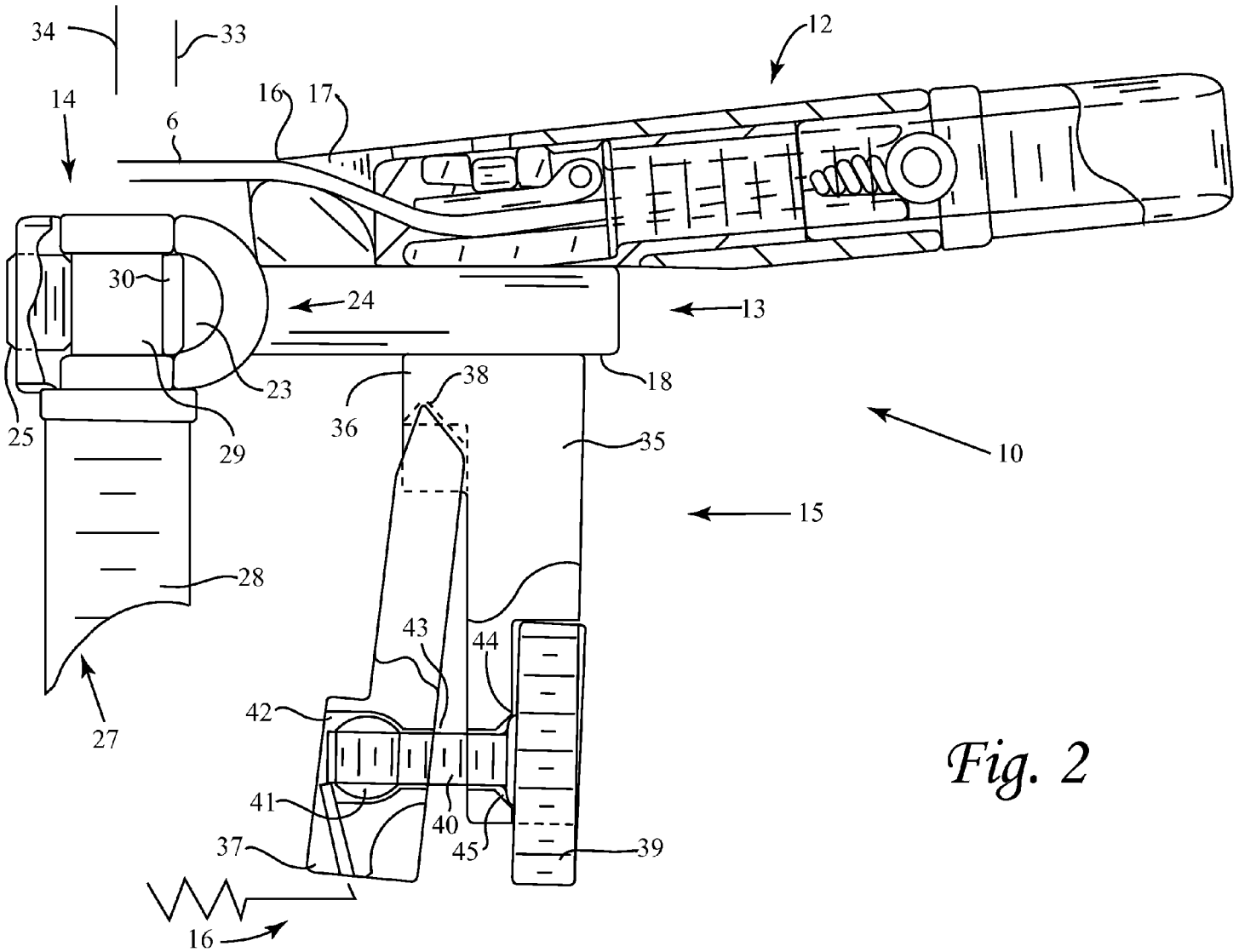
FIG. 2 is a side view of the tremolo mechanism showing the improved bearing arrangement with the annular recess of the riser post positioned to inter-cooperate with the articulated end of a bearing axle element within a novel integrated housing element. The figure shows the offset from the centerlines of the vertical riser post (comprising the abstract plane) relative to the pivot axis, similar to traditional knife edge geometry including a novel insert or key element to reduce lengthy installation/removal time.

FIG. 2 displays fulcrum tremolo 10 in a partial cross-section side view. Second critical point 16 is located on intonation module 12 in the area of the string opening 17 closer the nut and/or first critical point 8. The leading-edge portion of base plate 13, the area closest to nut 7, can comprise bearing housings 20 (shown in FIG. 4). Bearing housing 20 adjustably supports base plate 14 pivotally relative to body 3 at leading edge 19 (FIG. 4). Global Tuner 15 comprising four parts: inertia block or transverse element 35 connected to the base plate, holder element 37 extending to include knife-edge portion 38 to pivotally connect to transverse element 35, thumbwheel 39 and pivoting element 41, thumbwheel 39 threadably connecting to bearing-like element 41 supported by holder element 37.

FIG. 3 is a front partial cross-section view of the improved bearing arrangement connected to base plate 14 supporting intonation module 12 (only one is shown) comprising second critical point 16 further connected to inserts 47 positioned in body 3. The bearing arrangement comprises tube-like bearing housing 20 further comprising recesses 21 in each end of bearing housing 20 to receive bearing elements 22. Bearing axle 23 further comprises articulated end 31 to cooperate with annular recess 29 in riser post 27 to space bearing 22 and bearing axel housing 20 away from centerline 34 of riser post 27; key element 30 is shown. Holder element 37 is extended to include knife-edge portion 38 pivotally connected to inertia block 35 on support portion 36. Thumbwheel element 39 threaded portion 40 passes through recess 45 and small opening 43 (each not shown) in holder element 37 to threadably connect to bearing-like element 41. Bearing-like element 41 having a shape sufficient in size to be positioned within socket-like recess 42 to variably receive threaded portion 40, large enough in diameter to prevent passing through small opening 43 and sufficient in form to limit axial rotation of pivoting element 41 when threading thumbwheel 39.

FIGS. 4A and B are perspective views of the novel bearing assembly embodiments including the reversible integrated housing element. FIG. 5A details the improved bearing assembly 14 comprising integrated housing element 24 for supporting bearing axle element 23, positioned in a direction transverse the strings and forming axle pivot axis 33, and riser post element 27; riser post element 27, including vertical axis 34 as the centerline and side-view of the abstract plane and annular recess 29, generally perpendicular to the instrument body, comprising separate threaded portion 28 to position riser post 27 element within threaded insert 47 element in body 3. Bearing axle element 23 with articulated end 31 contacts annular recess 29 within integrated housing element 24 to secure the assembly to body 3 on an offset.

FIG. 4B, in a more preferred embodiment, shows bearing axle 23 having further articulated end 32, when combined with by annular recess 29 of riser post element 27, creates lock element 47 to receive key element 30 and variably secure bearing assembly 14 elements to themselves and to instrument body 3.

FIGS. 5A-D are pairs of side and top views of bearing assembly 16 including reversible integrated housing element 24 to show and non-lock and lock version of the improvement. Bearing assembly 16, not including the bearing housing and rest of the fulcrum tremolo such as the base plate intonation modules, bridge elements, etc. FIG. 5 A-B show interlocking articulated ends 31 of the axle 23 and riser post 27 annular recess 29 within integrated housing element 24 to define the offset between the bearing axle element centerline 33 and the riser post element centerline 34 (shown in the side view of the abstract plane) to secure fulcrum tremolo 10 to body 3.

FIGS. 5C-D show a variation that includes key element 30. Lock 46 is a recess created by the combination of further articulated end 32 and annular recess 29. Key element 30 inserted within lock 46 will the interlock axle element 23 with riser post element 27 annular recess 29 within the integrated housing element to secure fulcrum tremolo 10 to body 3—the novel key arrangement allows the tremolo to be installed and removed with much greater ease.

I claim:

1. An apparatus for a fulcrum tremolo mounted on the body of a stringed musical instrument for pivotally supporting strings, the stringed musical instrument further comprising a body, a neck extending outwardly from the body, a plurality of strings extending in a direction from the body to the neck, a nut on the opposite end of the neck from the body forming a first critical point for each of the strings, the fulcrum tremolo further comprising:

a pivot axis, a base plate, an interlocking bearing assembly, the interlocking bearing assembly comprising the pivot axis, the interlocking bearing assembly connected to the base plate to adjustably mount the fulcrum tremolo to the body, the interlocking bearing assembly comprising:

a bearing element, the bearing element comprising at least a portion of a ball bearing surface, a bearing housing element, the bearing housing element formed to receive the bearing element, a bearing axle element, the bearing axle element transverse the direction of the strings comprising a centerline, the bearing axle element centerline further comprising the pivot axis, the bearing axle element comprising an end portion, the end portion further comprising two end portions, a riser post element, the riser post element further comprising at least two riser posts, the riser post element further comprising a riser post centerline, the riser post centerline generally perpendicular to the body, the riser post centerline for each at least two riser posts extending transverse the strings comprising an abstract plane essentially perpendicular to the body, an integrated housing element, the integrated housing element further comprising:

a first bore, the first bore formed to receive the bearing axle element, and a second bore, the second bore formed to receive the riser post element, the first and second bore arranged to variably connect the riser post element to the end portion of the bearing axle element, wherein the bearing axle element centerline is offset from the abstract plane relative to the nut, the bearing axle element and the riser post element interlock within the integrated housing element, and the riser post element operable to threadedly position the bearing axle element relative to the body.

2. The apparatus of claim 1 wherein the riser post element further comprises:

a threaded end, the threaded end to variably position the fulcrum tremolo relative to the body, a plain end, the plain end further comprising an annular recess perpendicular to the riser post axis, the plain end having a plain end diameter, the annular recess diameter less than the plain end diameter, and the bearing axle element end portion further comprises an articulated end portion, the articulated end portion in variable contact with the annular recess, wherein the articulated end portion makes variable contact with the riser post element annular recess within the integrated housing element.

3. An apparatus for a fulcrum tremolo mounted on the body of a stringed musical instrument for pivotally supporting strings, the stringed musical instrument further comprising a body, a neck extending outwardly from the body, a plurality of strings extending in a direction from the body to the neck, a nut to form a first critical point for each of the strings, the fulcrum tremolo further comprising:

a pivot axis, a bearing assembly, the bearing assembly to adjustably mount the fulcrum tremolo to the body, the bearing assembly comprising the pivot axis, the bearing assembly further comprising:

a bearing element, the bearing element comprising at least a portion of a ball bearing surface, a bearing axle element, the bearing axle element transverse the direction of the strings, comprising a bearing axle element centerline, the bearing axle element centerline further comprising the pivot axis, the bearing axle element comprising at least one articulated end portion, the at least one articulated end portion further comprising at least a first portion of a key recess element, an integrated housing element, the integrated housing element formed to receive the riser post element and the bearing axle element, a riser post element, the riser post element further comprising at least two riser posts, the riser post element further comprising a riser post centerline, the riser post centerline generally perpendicular to the body, the riser post centerline for each at least two riser posts extending transverse the strings comprising an abstract plane essentially perpendicular to the body, the riser post element further comprising:

a threaded end, the threaded end to variably position the fulcrum tremolo relative to the body, a plain end, the plain end having a plain end diameter, the plain end further comprising an annular recess perpendicular to the riser post axis, the annular recess diameter less than the plain end diameter, the annular recess further comprising at least a second portion of a key recess element, a lock element, the lock element comprising a lock recess element, the lock recess element comprising the bearing axle element key recess element combined with the annular recess element, a key element, the key element operable to be inserted within the lock recess element, wherein the axle element, the key element and the riser post element interlock within the integrated housing element, to adjustably position the bearing axle element relative to the body.

4. The apparatus of claim 3, the integrated housing element further comprises:

a first bore, the first bore formed to receive the bearing axle element, a second bore, the second bore formed to receive the riser post element, wherein the first bore and the second bore arranged to offset the bearing axle element centerline from the abstract plane relative to the nut.

5. An apparatus for a fulcrum tremolo mounted on the body of a stringed musical instrument for pivotally supporting strings, the stringed musical instrument further comprising a body, a neck extending outwardly from the body, a plurality of strings extending in a direction from the body to the neck, a nut to form a first critical point for each of the strings, the fulcrum tremolo further comprising:

a pivot axis, a base plate comprising:

a pivot axis for the fulcrum tremolo, a first side furthest the body, a second side closer the body, a bridge element and a tailpiece element, a biasing element, the biasing element comprising a first end and a second end, the first end connected to the fulcrum tremolo and the second end connected to the body, the apparatus further comprising a lock element, the lock element comprising a lock recess and a key element, the apparatus further comprising a bearing arrangement, the bearing arrangement to adjustably and pivotally mount a fulcrum tremolo to the body, the bearing arrangement further comprising:

a bearing assembly, the bearing assembly connected to the base plate to adjustably mount the fulcrum tremolo to the body, the bearing assembly comprising:

a bearing element, the bearing element comprising at least a portion of a ball bearing surface, a bearing housing element, the bearing housing element formed to receive the bearing element, a bearing axle element, the bearing axle element transverse the direction of the strings, a riser post element, the riser post generally perpendicular to the body, the riser post element further comprising:

a threaded end, the threaded end to variably position the bearing assembly, and thereby, the fulcrum tremolo relative to the body, wherein an integrated housing element, the integrated housing element comprising the lock element and formed to receive the bearing axle element and the riser post element, the integrated housing element further comprising:

the bearing axle element centerline offset from the abstract plane relative to the nut, the riser post element operable to threadedly position the bearing axle element relative to the body, the key element operable to be inserted within the lock recess to adjustably secure the bearing axle element relative to the body.

* * * * *